US005090917A

United States Patent [19]

Noorily et al.

[11] Patent Number: 5,090,917

[45] Date of Patent: Feb. 25, 1992

[54] INSULATION DISPLACING CONNECTOR FOR PROVIDING REPEATABLE SEALED TERMINATION OF ELECTRICAL CONDUCTORS

[75] Inventors: Peter Noorily, Bridgewater; Sidney Levy, Belle Meade, both of N.J.

[73] Assignee: Thomas & Betts Corporation, Bridgewater, N.J.

[21] Appl. No.: 698,629

[22] Filed: May 10, 1991

[51] Int. Cl.[5] ..... H01R 4/24

[52] U.S. Cl. ..... 439/395; 439/417; 439/936

[58] Field of Search ..... 439/276, 519, 520, 936, 439/395–408, 271, 417–419

[56] References Cited

U.S. PATENT DOCUMENTS

| | | | |
|---|---|---|---|
| 4,645,285 | 2/1987 | Cozzens et al. | 439/395 |
| 4,734,061 | 3/1988 | Randall, Jr. et al. | 439/271 |
| 4,741,709 | 5/1988 | Jervis | 439/271 |
| 4,917,633 | 4/1990 | Lecoste | 439/936 |
| 4,954,098 | 9/1990 | Hollingsworth et al. | 439/936 |
| 4,993,966 | 2/1991 | Levy | 439/411 |
| 4,998,894 | 3/1991 | Gronvall | 439/936 |

*Primary Examiner*—David L. Pirlot

*Attorney, Agent, or Firm*—Robert M. Rodrick; Salvatore J. Abbruzzese

[57] ABSTRACT

An electrical connector provides for repeatable sealed termination of electrical conductors. The connector includes an insulative connector housing supporting therein an insulation displacing contact. The contact permits insertable and removable insulation displacing engagement with an insulated conductor. A sealing material is disposed within the housing around the contact for sealing the engagement of the contact with the conductor. The sealing material is displaceable upon insertable engagement of the conductor with the contact. The connector further includes a plunger supported adjacent the contact. The plunger is compressible in response to the insertable engagement of the conductor with the contact and returnable to an uncompressed condition upon removal of the conductor for returning the displaced sealing material to its original position.

14 Claims, 3 Drawing Sheets

INSULATION DISPLACING CONNECTOR FOR PROVIDING REPEATABLE SEALED TERMINATION OF ELECTRICAL CONDUCTORS

FIELD OF INVENTION

The present invention relates to an electrical connector for terminating insulated electrical conductors. More particularly, the present invention relates to an insulation displacing electrical connector which permits repeatable sealed connections with conductors.

BACKGROUND OF THE INVENTION

The electrical connector art has seen the widespread use of insulation displacing connectors. These connectors typically include an insulation displacing contact which makes connection to an insulated conductor by piercing the insulation thereof and making electrical engagement with the conductor.

Insulation displacing electrical connectors are used in many electrical applications. However, in those applications where the connector may be exposed to harsh environments such as outdoors in telecommunications applications or within the engine compartment of an automobile in automotive applications, it may be necessary to seal the point of connection between the insulation displacing contact and the conductor. Gels, lubricants, encapsulants and other sealants have long been used in insulation displacing electrical connectors to seal this connection interface.

One problem that has arisen, for example, in gel filled connectors, is that when a terminated insulated conductor is removed from the connector, the insulation around the conductor displaces or wipes away some of the protective gel from around the insulation displacing contact. Then, when a subsequent termination is desired to the same contact, the displacement of the gel will prevent the subsequent connection from being sealed. This is a particular problem where insulated conductors of different sizes are desired to be successively terminated in the same connector. If, for example, a relatively large insulated conductor is first terminated within the connector, it will displace a certain volume of gel. If upon its removal a smaller insulated conductor is to be terminated by the same contact, the connection interface will be exposed due to the displacement of the gel by the first conductor.

Accordingly, it is desirable to provide an electrical connector which will permit repeatable sealed insulation displacing terminations of insulated conductors.

It is further desirable to provide an electrical connector which will replace gel displaced by an initial termination, to its original position so that a subsequent termination may be sealed.

SUMMARY OF THE INVENTION

It is an object of the present invention to provide an electrical connector which permits sealed insulation displacing termination of insulated conductors.

It is a further object of the present invention to provide an electrical connector which permits repeatable sealed terminations of insulated conductors in insulation displacing fashion.

In the efficient attainment of these and other objects, the present invention provides an electrical connector for providing repeatable sealed electrical termination of an insulated conductor. The connector includes an insulative connector housing which supports therein an insulation displacing electrical contact. The contact permits insertable and removable insulation displacing electrical engagement with the insulated conductor. A displaceable sealing material is disposed within the housing around the contact for sealing the electrical engagement of the contact with the conductor. The sealing material is displaceable upon insertable engagement of the conductor with the contact. The connector further includes plunger means supported adjacent the contact. The plunger means is compressible in response to the insertable engagement of the conductor with the contact and returnable to an uncompressed condition upon removal of the conductor from electrical engagement with the contact. The plunger means returns the displaced sealing material upon removal of the conductor from electrical engagement with the contact.

As more particularly described by way of the preferred embodiment herein, the connector includes an insulative base and an insulative cover movably supported over the base. The cover accommodates the insulated conductor for movement with respect to the base. Movement of the cover towards the base urges the insulated conductor into insulation displacing connection with the contact. Movement of the cover away from the base removes the conductor from connection with the contact. The insulation displacing electrical contact includes a pair of spaced-apart beams having upper insulation piercing edges and defining therebetween a conductor receiving slot. Flowable sealing material surrounds the contact and is further disposed adjacent the upper insulation piercing edges of the contact. An elongate plunger is positioned within the slot and includes an upper surface adjacent the upper insulation piercing edges of the contact. Upon removal of the conductor from connection with the contact, the upper surface of the plunger returns displaced sealing material to a location adjacent the upper insulation piercing edges of the contact.

DETAILED DESCRIPTION OF THE PREFERRED EMBODIMENT

Figure 1:
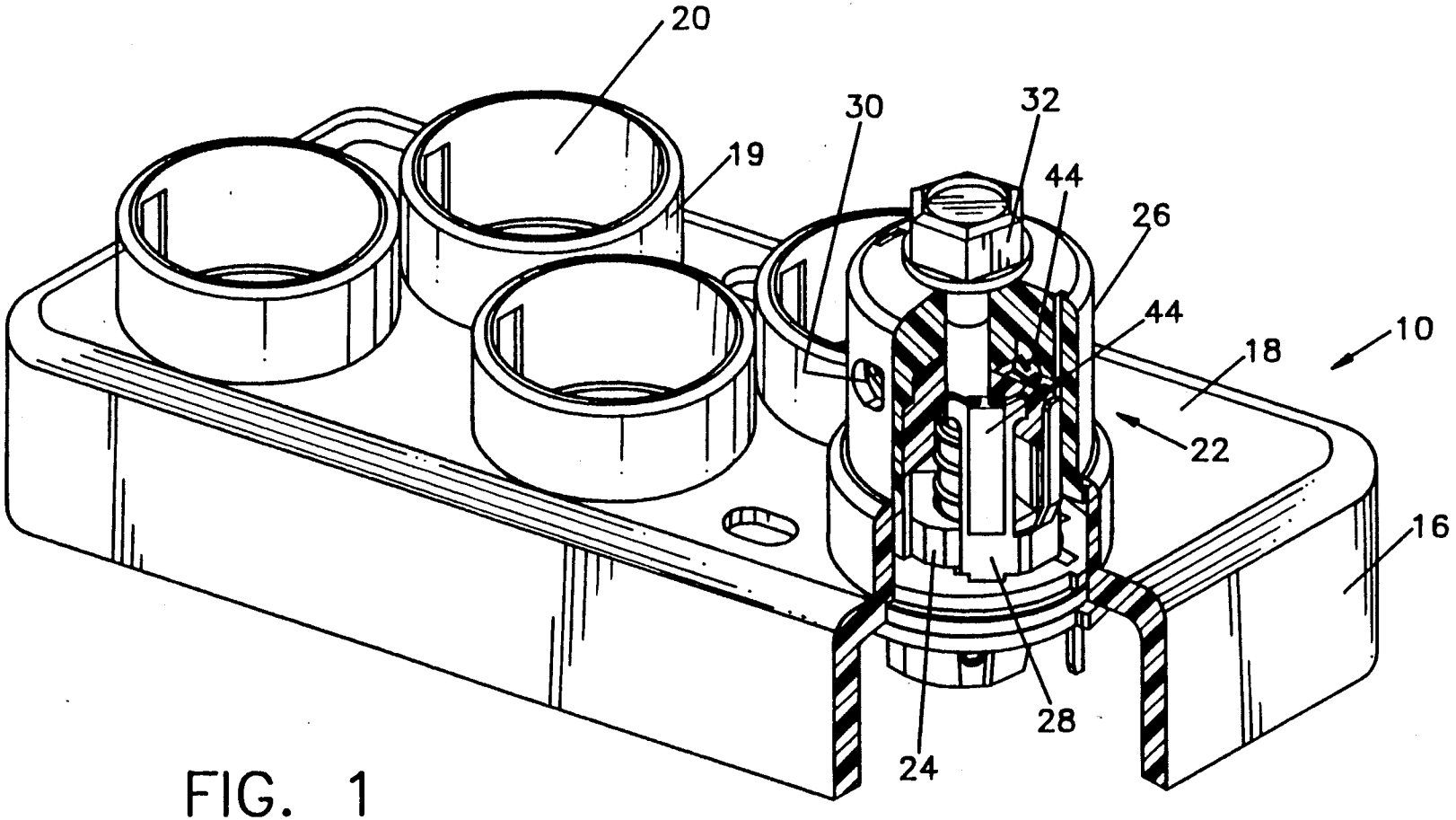
FIG. 1 is a top perspective view, partially in section, of an insulation displacing electrical connector of the present invention.
Figure 3:
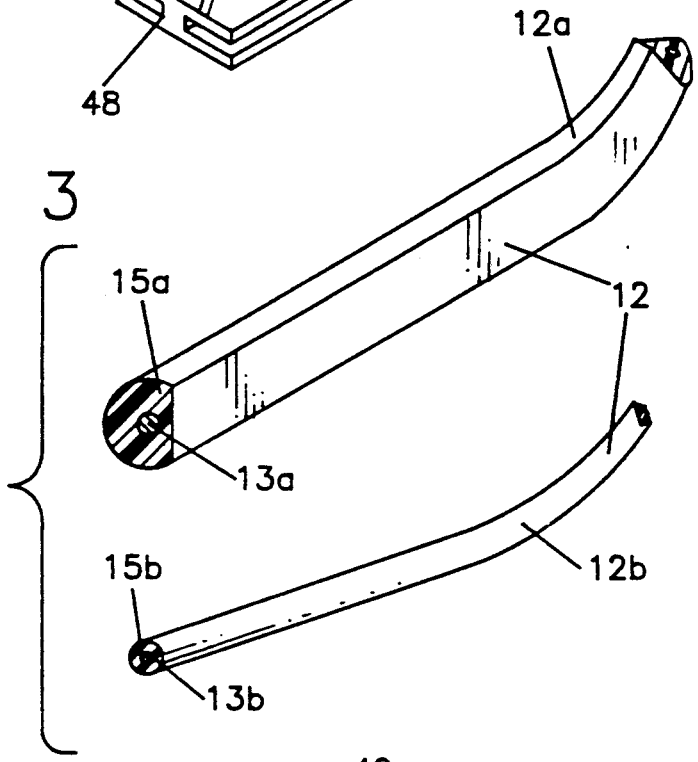
FIG. 3 shows, partially in section, examples of insulated conductors used in accordance with the present invention.

Referring to FIG. 1, an electrical connector block 10 used in accordance with the present invention is shown. Connector block 10 is used to terminate electrical wires 12 which are shown in FIG. 3. Connector block 10 generally includes an elongate plastic housing 16 having a planar upper surface 18 and a plurality of circular apertures 20 extending therethrough. An upstanding wall 19 about each aperture 20 supports an electrical terminal module 22.

Each terminal module 22 terminates in insulation displacing fashion, pairs of identical wires 12, two types of which are shown in FIG. 3. Each pair of wires 12 can include a first pair of wires 12*a* having a center conductor 13*a* surrounded by insulation 15*a* of relatively large diameter or a second pair of wires 12*b* having a center conductor 13*b* and insulation 15*b* of smaller diameter therearound. The connector block 10, as well as the terminal module 22 and the method of terminating wires 12 are more fully shown and described in commonly assigned U.S. Pat. No. 4,993,966; issued Feb. 19, 1991, which is incorporated by reference herein for all purposes.

Generally, each terminal module 22 includes a base 24 supported within circular aperture 20, a cap 26 movable supported over base 24, and insulation displacing contacts 28 supported between the base 24 and cap 26. Cap 26 includes openings 30 which position wires 12 over insulation displacing contacts 28. Movement of the cap 26 toward base 24 under actuation of screw 32, causes wires 12 to be terminated in insulation displacing fashion onto contacts 28.

Terminal module 22 includes a sealing gel 34 (FIGS. 4 through 6) which provides for an environmental seal at the connection between wires 12 and insulation displacing contacts 28. Gel 34 is of the type commonly used for such purpose. In the present embodiment silicone is used as a sealing gel. Removal of wires 12 may be effected by reverse actuation of screw 32 which draws cap 26 upwardly away from base 24 and dislodges wires 12 from insulation displacing contacts 28. Terminal module 22 may then be reused to terminate another pair of wires 12. In fact, terminal module 22 may e used to initially terminate a pair of larger wires 12*a* and then subsequently used to terminate a pair of smaller wires 12*b*.

In telephone applications, which is the environment in which the present invention especially is used, two sizes of wire are typically employed. Larger wire 12*a* (FIG. 3) is 18½ AWG solid wire, commonly referred to as F-drop. Wire 12*a* has a conductor diameter of 0.035 inches, and a D-shaped insulation having a diameter of approximately 0.160 inches. The present invention also terminates smaller wire 12*b* which is 24 AWG solid wire having a conductor diameter of 0.020 inches and insulation diameter of 0.040 inches. The connector of the present invention is designed to permit repeated terminations of pairs of both wires 12*a* and 12*b* in an environmentally sealed manner.

In repeated termination, it is difficult to maintain an effective seal between the center conductor of wires 12 and insulation displacing contact 28, as the sealing gel 34 which establishes such environmental seal has a tendency to be wiped away during termination. This is especially true when larger wire 12*a* is initially terminated and removed and smaller wire 12*b* is subsequently terminated to the same contact 28.

Figure 2:
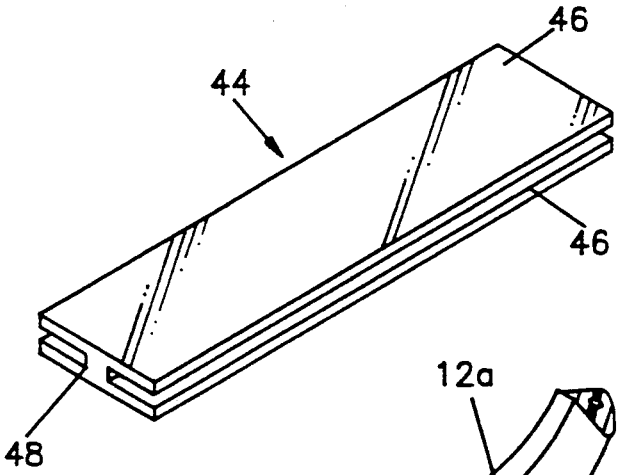
FIG. 2 is a top perspective showing of a plunger used in accordance with the connector of FIG. 1.
Figure 4:
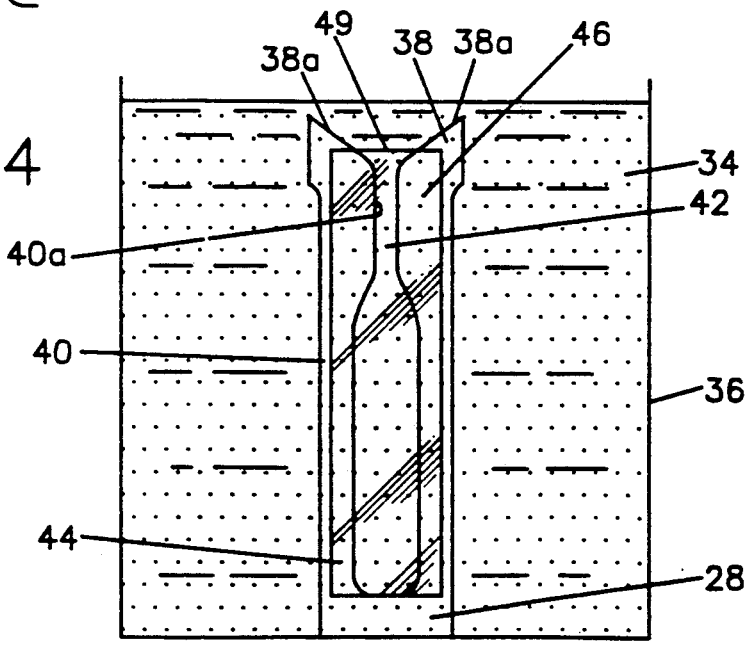
FIG. 4 shows schematically, the insulation displacing contact shown in FIG. 1, including the plunger of FIG. 2, surrounded by a sealing gel.

Referring now to FIGS. 2 and 4, in order to replace gel 34 displaced by the initial termination and removal of wires 12 from insulation displacing contact 28, the present invention contemplates providing a mechanism to the return gel 34 displaced by the initial termination and removal of one of wires 12, so that a subsequent termination may also be environmentally sealed.

FIG. 4 shows schematically insulation displacing contact 28 supported in a container 36 representing area between base 24 and cap 26 (FIG. 1). Container 36 is filled with a sealing gel 34 as described in detail in the above-identified '966 patent. Insulation displacing contact 28 includes an upper insulation displacing portion 38 and a pair of spaced-apart beams 40 defining therebetween a conductor receiving slot 42. As is typical with insulation displacing contacts, upper insulation displacing portion 38 includes spaced knife-like edges 38*a* which sever the insulation of wires which are inserted therein. Conductive engagement is made within slot 42 by inwardly facing surfaces 40*a* of beams 40.

Figure 5:
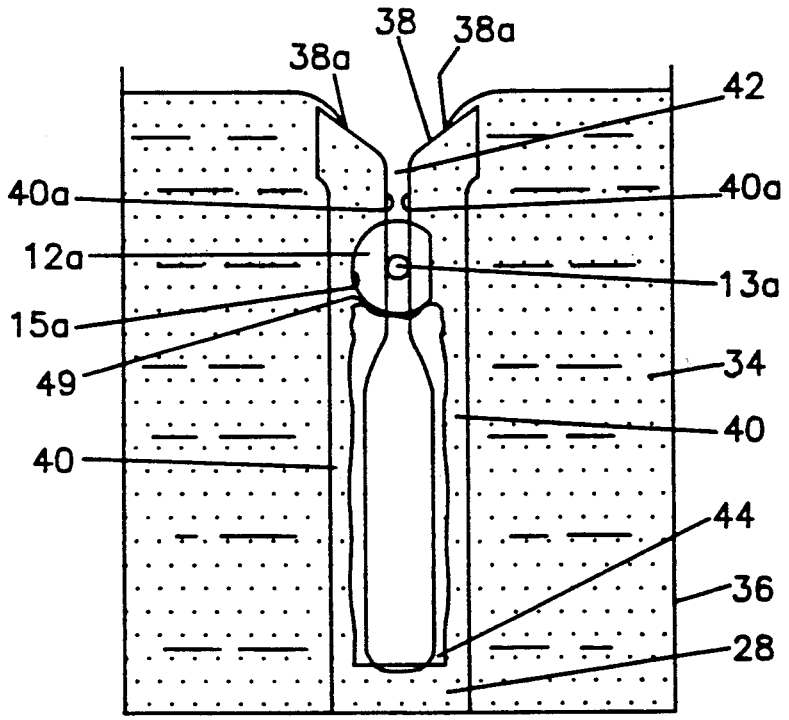
FIG. 5 shows the contact of FIG. 4 electrically terminated to one of the conductors shown in FIG. 3.

FIG. 5 shows wire 12*a* terminated by contact 28. Once wire 12*a* is terminated by contact 28, a certain amount of gel 34 will be displaced thereby. When wire 12*a* is removed, and another wire, such as wire 12*b*, is subsequently terminated, the displaced gel may not adequately seal the location of the engagement of the wire 12*b* with contact 28.

In order to replace the gel 34 displaced by termination of wire 12*a* with contact 28, the present invention provides a plunger 44, which is shown in detail in FIG. 2. Plunger 44 is responsive to the termination and removal of wires 12 to replace the gel 34 displaced by termination. Plunger 44 is an elongate generally rectangular member formed of a resiliently compressible elastomer, such as urethane. Plunger 44 includes a pair of spaced planar members 46 connected by an elongate central web 48. As shown in FIG. 4, plunger 44 is positioned on contact 28 with web 48 disposed within slot 42. (see also FIG. 1) Each of planar members 46 straddles contact 28.

Referring again to FIG. 5, the compressible construction of plunger 44 makes it compressibly responsive to the termination of wire 12*a*. Wire 12*a* is terminated by moving the wire downwardly into engagement with insulation displacing portion 38 so that the insulation 15*a* thereof is pierced by knife-like edges 38*a*. Further downward movement of wire 12*a* causes conductive engagement of conductor 13*a* with inwardly facing surfaces 40*a* of beams 40 within slot 42. This movement of wire 12*a* also compresses plunger 44 so that an upper surface 49 thereof is urged from its original position shown in FIG. 4 to a compressed position shown in FIG. 5. As may be appreciated, a certain amount of gel 34 is displaced or wiped away from beams 40 as well as from slot 42 by the termination of wire 12*a*. Some of this displaced gel will be pooled or collected at the upper surface 49 of plunger 44. When wire 12*a* is removed from termination with contact 28, plunger 44 will resiliently return to its original position shown in FIG. 4. The upper surface 49 of plunger 44 serves to return displaced gel pooled thereon, to a position adjacent insulation displacing portion 38.

Figure 6:
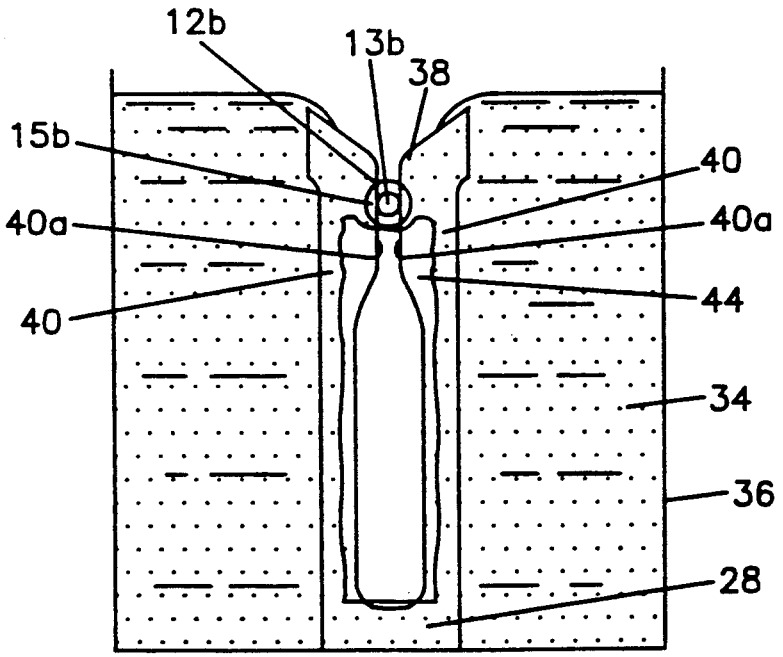
FIG. 6 shows the contact of FIG. 4 electrically terminated to the other conductor of FIG. 3.

Referring now to FIG. 6, the subsequent termination of wire 12*b* is shown. Having returned an amount of displaced gel 34 to a location adjacent insulation displacing portion 38, wire 12*b* which is terminated in a manner similar to that of wire 12*a* described above, will also be terminated in sealed engagement with insulation displacing contact 28. The gel 34 has been replaced along beams 40 of contact 28 as well as within the upper portion of slot 42. The gel 34 will effectively seal the interface between the conductor 13*b* of wire 12*b* and the inwardly facing surfaces 40*a* of beams 40. Plunger 44 will again be resiliently compressed by the termination of wire 12*b* to permit further subsequent replacement of displaced gel 34. Thus the present invention contemplates numerous subsequent terminations wires 12*a* and 12*b* to contact 28 while still maintaining sealed engagement with contact 28.

Various changes to the foregoing described and shown structures would now be evident to those skilled in the art. Accordingly, the particularly disclosed scope of the invention is set forth in the following claims.

I claim:

1. An electrical connector for providing repeatable sealed termination of an electrical wire having a center conductor and insulation therearound, said connector comprising:

an insulative base;

an insulation displacing electrical contact supported by said base, said contact being defined by a pair of spaced-apart beams having upper insulation piercing edges defining a wire receiving location thereat and defining a conductor receiving slot therebetween;

an insulative cover movably supported over said base including means for removably accommodating said wire, said cover being movable toward said base for urging said wire into insulation displacing electrical connection with said contact and away from said base for removing said wire from said connection with said contact;

a flowable sealing material surrounding said contact and further positioned at said wire receiving location, said sealing material being displaceable from said location by said urging of said wire into said insulation displacing connection with said contact; and a plunger positioned within said slot, said plunger having an upper surface adjacent said wire receiving location, said plunger being compressible from an uncompressed condition to a compressed condition upon said urging of said wire into insulation displacing connection with said contact and returnable to said uncompressed condition upon said removing of said wire from said connection with said contact, said upper surface of said plunger returning said displaced sealing material to said wire receiving location upon said return of said plunger to said uncompressed condition.

2. An electrical connector of claim 1 wherein said sealing material is silicone.

3. An electrical connector of claim 1 wherein said spaced-apart beams are flat blades having inwardly tapering upper edges defining said insulation piercing edges, said inwardly tapering upper edges leading to said slot.

4. An electrical connector of claim 3 wherein said flat blades include opposed inwardly directed longitudinal edges.

5. An electrical connector of claim 4 wherein upon said movement of said cover toward said base said insulation displacing electrical connection is established between said conductor and said longitudinal edges of said blades.

6. An electrical connector of claim 3 wherein said plunger includes a pair of spaced elongate planar members joined by an elongate central web.

7. An electrical connector of claim 6 wherein said central web of said plunger is disposed within said slot of said contact.

8. An electrical connector of claim 7 wherein plunger is formed of a resilient elastomer.

9. An electrical connector of claim 8 wherein said resilient elastomer is urethane.

10. An electrical connector of claim 7 wherein said planar surfaces of said plunger lie along said flat blades of said contact.

11. An electrical connector for repeatable sealed electrical/termination of an insulated conductor comprising:

an insulative housing;

an insulation displacing electrical contact supported by said housing for insertably and removably receiving said conductor in insulation displacing electrical engagement;

a displaceable sealing material disposed within said housing around said contact for sealing said electrical engagement of said contact with said conductor, said sealing material being displaced upon said insertable engagement of said conductor with said contact; and plunger means supported adjacent said contact, said plunger means being compressible in response to said insertable engagement of said conductor with said contact and returnable to an uncompressed condition upon said removal of said conductor from electrical engagement with said contact, said plunger returning said displaced sealing material upon said removal of said conductor from electrical engagement with said contact.

12. An electrical connector of claim 11 wherein said insulation displacing electrical contact includes a pair of spaced-apart blades having upper extents for cutting insulation of said insulated conductor and an elongate slot therebetween for receipt of said conductor in electrical engagement.

13. An electrical connector of claim 12 wherein said plunger means includes an elongate member supported within said slot of said contact.

14. An electrical connector of claim 13 wherein said plunger includes an upper end surface positioned adjacent said upper extents of said blades when said plunger is in said uncompressed condition and wherein said upper end surface of said plunger repositions said sealing material adjacent said upper extents of said blades upon said removal of said conductor from electrical engagement with said contact.

* * * * *